US008309288B2

(12) United States Patent
Okada et al.

(10) Patent No.: US 8,309,288 B2
(45) Date of Patent: Nov. 13, 2012

(54) COLOR TONER AND PREPARATION METHOD THEREOF

(75) Inventors: Hisao Okada, Suwon-si (KR); Mitsuru Oikawa, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 700 days.

(21) Appl. No.: 12/421,726

(22) Filed: Apr. 10, 2009

(65) Prior Publication Data

US 2009/0317737 A1 Dec. 24, 2009

(30) Foreign Application Priority Data

Jun. 24, 2008 (KR) ..... 10-2008-0059546

(51) Int. Cl.
*G03G 9/08* (2006.01)

(52) U.S. Cl. ..... 430/108.1; 430/110.1; 430/110.2

(58) Field of Classification Search ..... 430/108.1, 430/110.1, 110.2
See application file for complete search history.

(56) References Cited

U.S. PATENT DOCUMENTS

| | | | | |
|---|---|---|---|---|
| 4,085,057 | A * | 4/1978 | Masuda et al. | 430/108.21 |
| 4,299,903 | A | 11/1981 | Auclair et al. | |
| 4,624,907 | A * | 11/1986 | Niimura et al. | 430/108.23 |
| 5,885,739 | A * | 3/1999 | Dalal et al. | 430/107.1 |
| 2004/0029031 | A1 * | 2/2004 | Yamazaki et al. | 430/137.14 |
| 2005/0053857 | A1 * | 3/2005 | Nakamura et al. | 430/108.21 |
| 2005/0079434 | A1 | 4/2005 | Suzuki et al. | |
| 2007/0202430 | A1 | 8/2007 | Suzuki et al. | |
| 2008/0044752 | A1 * | 2/2008 | Nakatani et al. | 430/108.23 |
| 2008/0182189 | A1 * | 7/2008 | Sensui | 430/108.2 |
| 2008/0299475 | A1 * | 12/2008 | Kidokoro | 430/108.4 |

FOREIGN PATENT DOCUMENTS

| | | |
|---|---|---|
| JP | 07-191544 | 7/1995 |
| KR | 10-2005-0035111 | 4/2005 |

OTHER PUBLICATIONS

English Abstract of KR-10-2005-0035111.
English Abstract of JP-07-191544.
English language translation of JP-07-191544.

* cited by examiner

*Primary Examiner* — Hoa V Le
(74) *Attorney, Agent, or Firm* — Stanzione & Kim, LLP

(57) ABSTRACT

A color toner is provided which has a dielectric strength equal to or lower than that of a black toner containing carbon black, and which has an improved charging rate and charge stability against changes in the environment.

6 Claims, 10 Drawing Sheets

$E_k = (E_t - E_c)/2$
(Average)

COLOR TONER AND PREPARATION METHOD THEREOF

CROSS-REFERENCE TO RELATED APPLICATIONS

This application claims the benefit under 35 U.S.C. §119 (a) of Korean Patent Application No. 10-2008-0059546, filed on Jun. 24, 2008, in the Korean Intellectual Property Office, the disclosure of which is incorporated herein by reference in its entirety.

TECHNICAL FIELD

The present invention relates to color toner and a preparation method thereof, and more particularly, to a color toner of improved charging characteristics, and a preparation method thereof.

BACKGROUND OF RELATED ART

There is an increasing demand for image forming apparatuses employing electrophotographic technologies capable of printing full color images that are small, fast and affordable. Image forming apparatuses supply toner in small quantities each time printing is performed, and rapidly charge the supplied toner in order for continuous printing.

A compact sized image forming apparatus includes a proportionally compact sized developing device, and so the quantities of developer used by which may also be relatively small. Accordingly, the time between when toner is supplied and when toner is used for developing may be shortened.

In order to achieve a miniaturized high-speed developing device, electric charge to the toner should be provided at a higher charging rate. However, charging rates for color toner generally tend to be lower than that of black toner. If the charging rate is low, the toner may not be charged to a sufficient level, resulting in the toner particles being scattered. That is, when no toner scattering occurs if black toner is used, some toner scattering and resulting contamination of the internal components of the same developing device may still occur if color toner is being used.

Frictional electrification or triboelectric charging can be utilized to provide the electric charge to the toner. Frictional electrification however is susceptible to changes in the environment. In particular, if color toner is used, the amount of charge may vary considerably according to the changes in the environment, for example, a change in humidity. That is, for example, if the humidity is high, the charge imparted to the toner may be reduced, possibly resulting in toner particles scattering. When amount of toner charge changes, the print density may also change, which in turn may adversely impact the print quality.

Therefore, it is desirable to reduce the susceptibility of the charge amount of the toner to the environmental conditions, such as, e.g., humidity changes, particularly for a compact high-speed developing device.

SUMMARY OF DISCLOSURE

According to one aspect of the present invention, a color toner may be provided to have its dielectric strength substantially equal to or lower than that of a black toner containing carbon black.

The dielectric strength of the color toner may be within a range of approximately 10000 V/cm to approximately 120000 V/cm.

The color toner may include an antistatic agent that lowers the dielectric strength of the color toner.

The antistatic agent may be a substantially transparent or light colored resin having a volume resistivity equal to or lower than $10^9$ Ωcm.

The color toner may include a plurality of toner particles and a carbon black-containing layer formed on the surfaces of the plurality of toner particles. The carbon black-containing layer may lower the dielectric strength of the color toner.

According to another aspect, a method of preparing a color toner may include mixing together at least a colorant, an antistatic agent, wax and binder resin to form a mixture, kneading the mixture and pulverizing the kneaded mixture. The antistatic agent may be a substantially transparent or light colored resin with a volume resistivity equal to or lower than $10^9$ Ωcm. The color toner may have a dielectric strength that is within a range of approximately 10000 V/cm to approximately 120000 V/cm.

According to yet another aspect, a method of preparing a color toner may include preparing a first emulsified solution containing at least a colorant, water and dispersing agent, adding a monomer to the first emulsified solution and performing an emulsion polymerization reaction to produce primary color toner particles, preparing a second emulsified solution containing at least water, dispersing agent and carbon black, adding a monomer to the second emulsified solution to produce a dispersing solution and adding the dispersing solution to the prepared primary color toner particles, and performing the emulsion polymerization reaction to form the color toner. The color toner may have a dielectric strength that is within a range of approximately 10000 V/cm to approximately 120000 V/cm.

The method may further include forming a carbon black-added layer coating surfaces of the primary color toner particles.

According to even yet another aspect, a toner for use in developing an electrostatic latent image in an image forming apparatus may comprise a colorant that does not contain carbon black, a dielectric strength control agent and a binder resin binding the colorant and the dielectric strength control agent together. The dielectric strength control agent may cause the dielectric strength of the toner to be lower than it would have been without the dielectric strength control agent.

The dielectric strength of the toner may be substantially equal to or lower than that of a black toner containing carbon black.

The dielectric strength of the toner may be within a range of approximately 10000 V/cm to approximately 120000 V/cm.

The dielectric strength control agent may comprise a substantially transparent electrically conductive material.

The dielectric strength control agent may be a resin having a volume resistivity equal to or lower than $10^9$ Ωcm.

The dielectric strength control agent may comprise a layer containing carbon black formed on outer surface of the toner.

The toner may be black toner.

BRIEF DESCRIPTION OF THE DRAWINGS

Various aspects of the present disclosure will become apparent and more readily appreciated from the following description of the embodiments, taken in conjunction with the accompanying drawings, of which.

DETAILED DESCRIPTION OF SEVERAL EMBODIMENTS

Figure 1A:
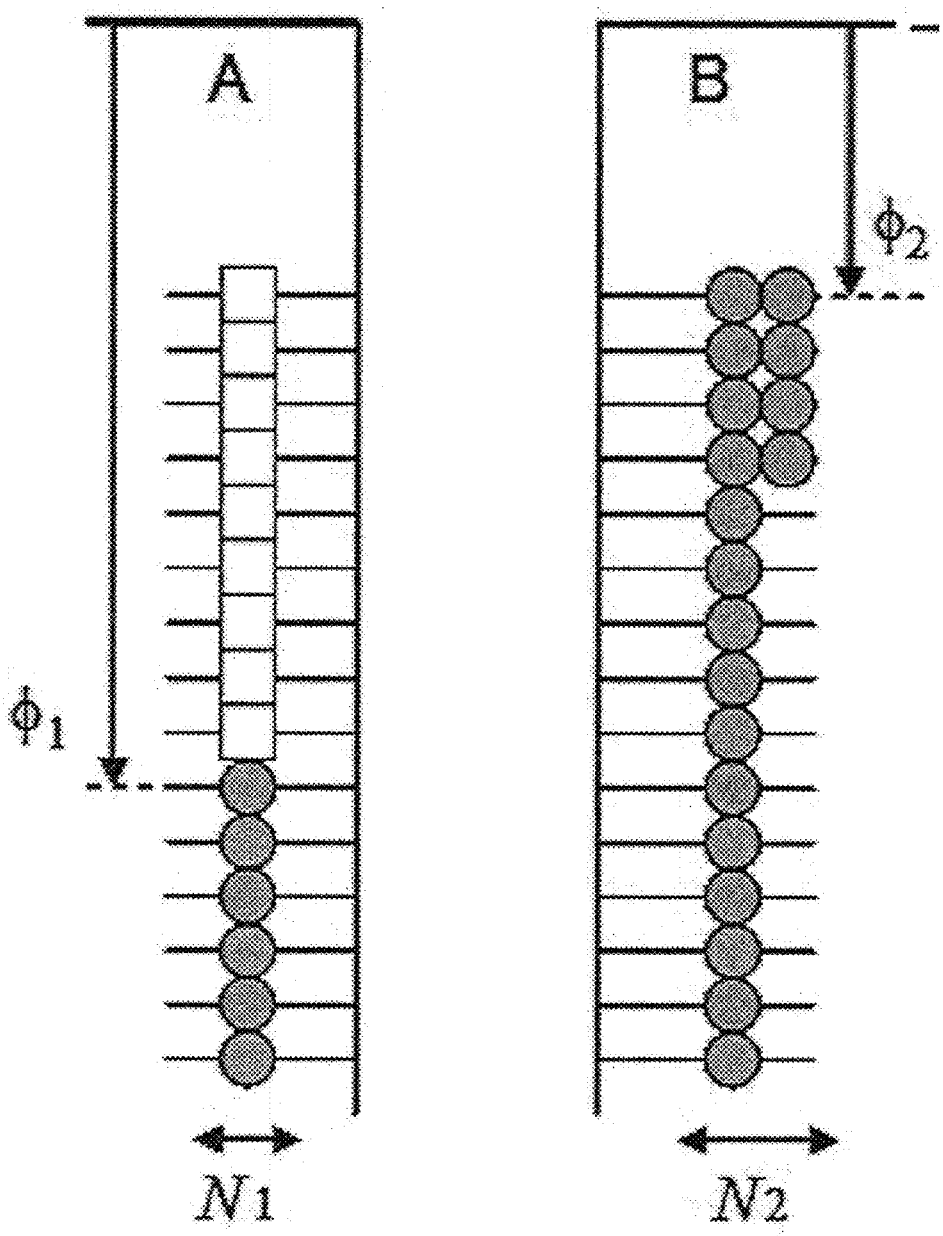
FIG. 1A depicts the energy level prior to substances A and B coming into contact with each other, to illustrate the contact electrification principles pertinent to the preparation of color toner according to an embodiment of the present invention.

Several embodiments of the present invention will now be described in greater detail with reference to the accompanying drawings. In the following description, same drawing reference numerals are used for the same elements or features even in different drawings. While the embodiments are described with detailed construction and elements to assist in a comprehensive understanding of the various applications and advantages of the embodiments, it should be apparent however that the embodiments can be carried out without those specifically detailed particulars. Also, well-known functions or constructions will not be described in detail so as to avoid obscuring the description with unnecessary detail.

Carbon black may be used to control electrification, due to its black coloration, however, is not employed in color toner. Even when carbon black particles are included in the coating layer of a carrier, if the coating layer becomes partially peeled off, for example, a problem of turbidity may occur, it is thus difficult to use carbon black in practice. Moreover, the precise electrification control mechanism of carbon black is not well known.

In order to describe the color toner capable of high speed charging and exhibiting improved charge stability over environmental condition changes according to embodiments of the present disclosure, the pertinent aspects of electrification between a color toner particle and carrier is discussed below, starting first with a discussion of the contact electrification based on the surface state theory.

Figure 1B:
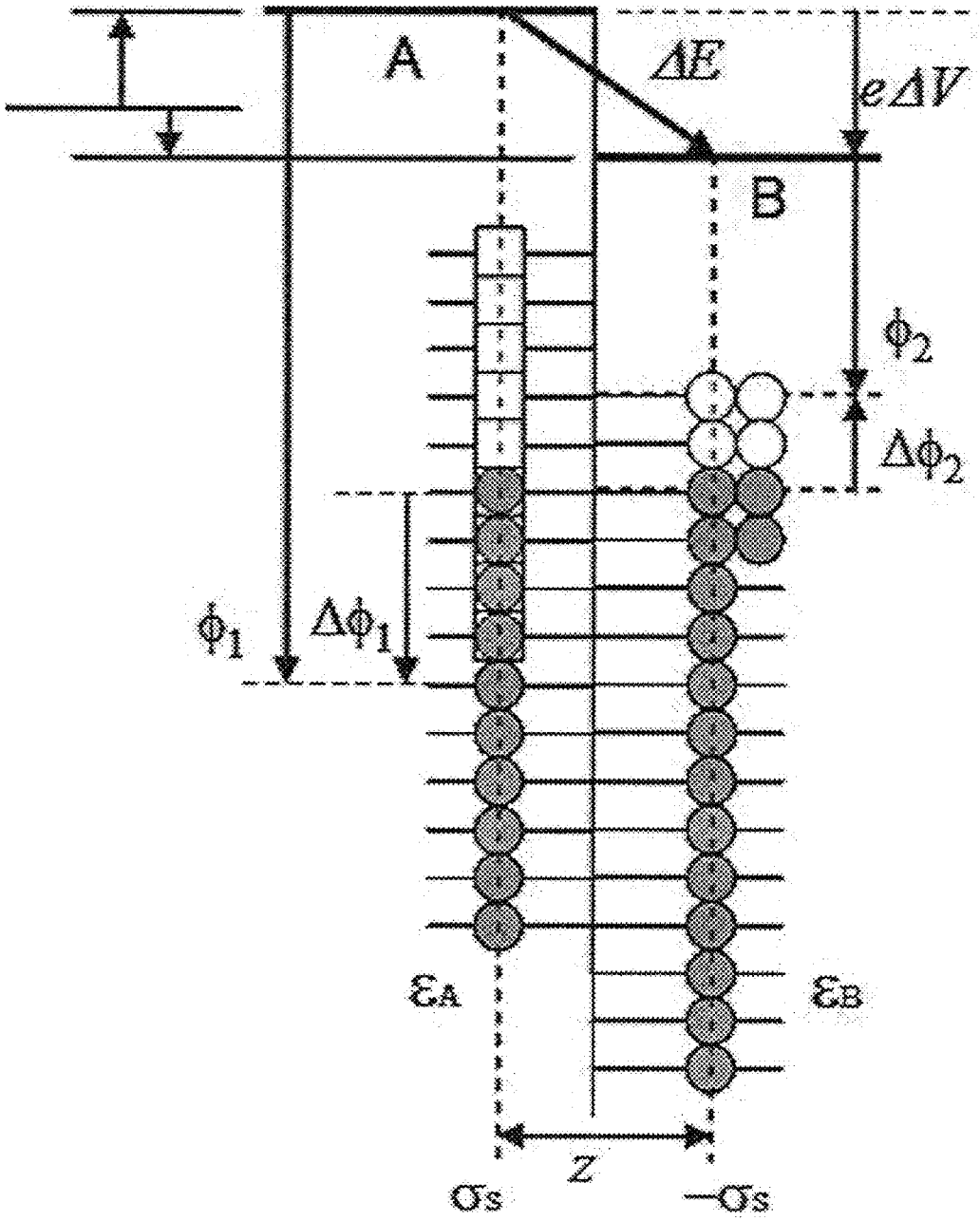
FIG. 1B depicts the energy level after substances A and B make contact with each other.

Referring to FIGS. 1A and 1B, black circles indicate electrons, white rectangles indicate rooms or holes into which the electrons may enter, and white circles indicate empty rooms from which electrons have been output. The vertical axis in FIGS. 1A and 1B indicates the energy level of the electrons.

As shown in FIG. 1A, substance A contains electrons, the energy level of which is deeper than energy level Φ1, and substance B contains electrons, the energy level of which is deeper than energy level Φ2, each energy level Φ1 and energy level Φ2 relating to the work function. The number of rooms which the electrons participating in the electrification are able to access for energy per unit of area of a surface of a substance is referred to as its surface state density. In FIGS. 1A and 1B, surface state density N1 indicates the number of rooms of substance A into which electrons may enter, and surface state density N2 indicates the number of rooms of substance B from which electrons may leave.

Substance A differs from substance B in its work function. If two substances with different work functions come into contact with each other, electrons may move from the substance with a relatively low work function to the other substance. For example, referring to FIG. 1A, the electrons of substance B may move to substance A, and the energy level of electrons of substance A may increase, and thus the electric potential may change according to the energy level of the electrons of substance A. On the other hand, since the electrons have left the substance B, the energy level of electrons of substance B may be reduced, and the electrical potential may also change according to the energy level of electrons of substance B. An electric field may be formed between the electric charges of substances A and B. The electric field may interrupt the movement of electrons, and as a result, if the energy level of electrons reaches the average energy level, the electric potential may not change further. FIG. 1B depicts electrons having energy levels which have reached the average energy level.

In FIG. 1B, $\sigma_s$ represents the surface charge density of substance A, and may satisfy the following Equation 1 as depicted in FIGS. 1A and 1B.

$$\sigma_s=-e\cdot N1\cdot\Delta\Phi1 \quad \text{\{Equation 1\}}$$

Additionally, $-\sigma_s$ represents the surface charge density of substance B, and may satisfy the following Equation 2 as depicted in FIGS. 1A and 1B.

$$-\sigma_s=-e\cdot N2\cdot\Delta\Phi2 \quad \text{\{Equation 2\}}$$

The relationship of potential difference ΔV between substances A and B, electric field ΔE between substances A and B, and work functions of substances A and B may satisfy the following Equation 3.

$$e\cdot\Delta V=-e\cdot\Delta E\cdot z=(\phi1-\Delta\phi1)-(\phi2-\Delta\phi2) \quad \text{\{Equation 3\}}$$

In Equation 3, z indicates the distance between the electric charges of substances A and B. The surface charge density may be obtained by combining the dielectric constant and electric field. While different substances may typically have different dielectric constants, for the purpose of facilitating the discussions of the equations, and according to an embodiment, substances A and B may be assumed to have the same dielectric constant. For example, a resin usable for preparing the color toner may include, for example, styrene acryl or polyester, and an acryl or silicon resin may be used to coat a surface of a carrier. If the dielectric constant is represented by the relative dielectric constant in vacuum, substances A and B may have the same dielectric constant of approximately 3 to 4.

Substituting Equation 1 and Equation 2 into Equation 3, the following Equation 4 may be obtained.

$$\sigma_s=\in\cdot\Delta E=\in\cdot 1/ez[\phi2-\phi1-\sigma_s/e(1/N1+1/N2)] \quad \text{\{Equation 4\}}$$

The surface charge density $\sigma_s$ may satisfy the following Equation 5, which is derived from Equation 4 above.

$$\sigma_s=e(\phi_2-\phi_1)/(e^2z/\in)+(1/N_1+1/N2) \quad \text{\{Equation 5\}}$$

Equation 5 above provides the basic equation for the surface charge density during the contact electrification based on the surface state theory.

It is further assumed that the potential difference ΔV varying according to the movement of electric charges does not contribute to the contact electrification, that is, ΔV=0. The electric field is formed according to the movement of electric charges, thus if z in Equation 3 is 0, the potential difference ΔV may thought as being 0. Accordingly, Equation 5 may be simplified to the following Equation 6.

$$\sigma_s=e(\phi2-\phi1)/(1/N1+1/N2) \quad \text{\{Equation 6\}}$$

Based on Equation 6, the relationship between the toner charge-to-mass ratio Q/M and the mixing ratio T/C of a toner to a carrier may be described.

Figure 2A:
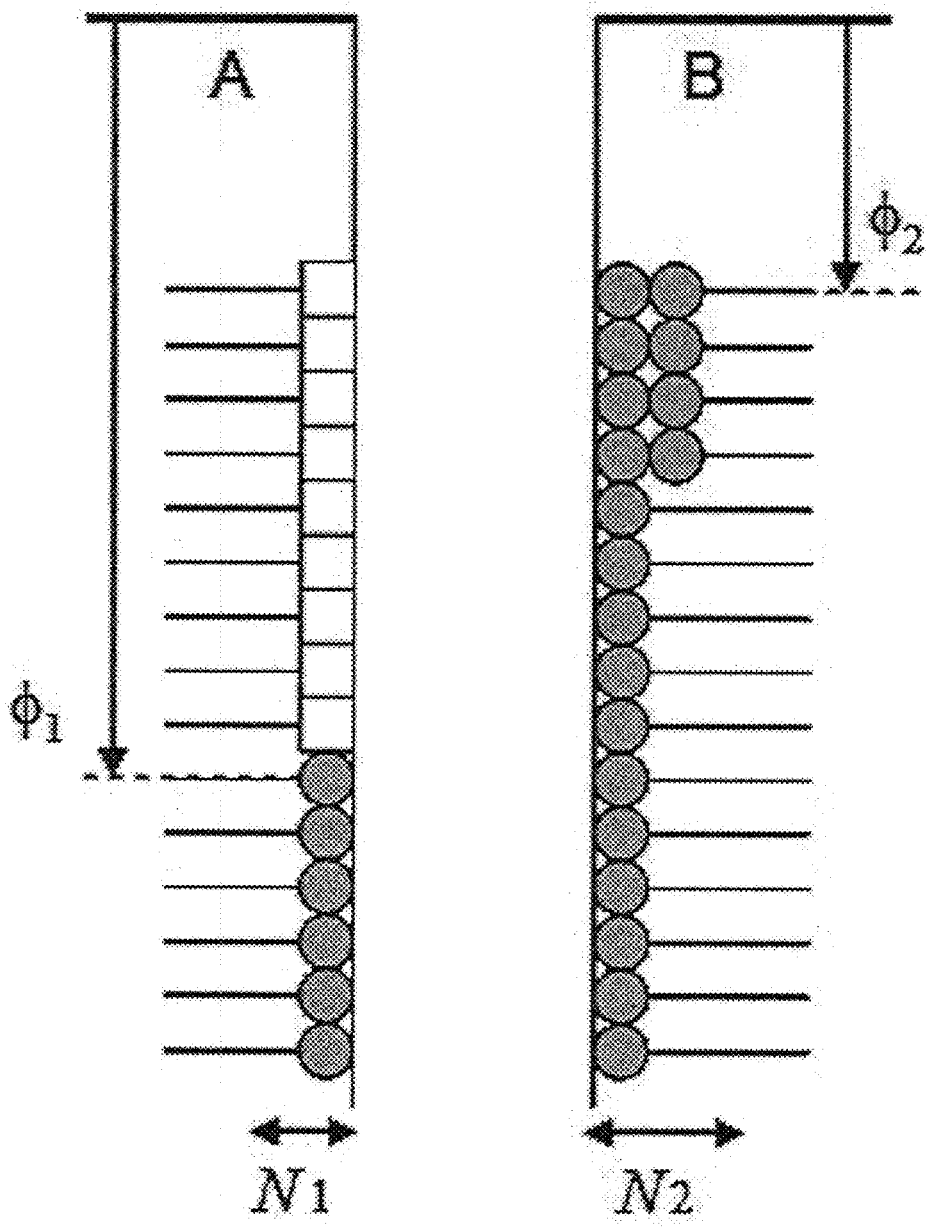
FIG. 2A depicts the energy level before substances A and B are in contact with each other, to illustrate the contact electrification theory regardless of a change in the electric potential and explain a preparation method of a color toner according to an exemplary embodiment of the present invention.
Figure 2B:
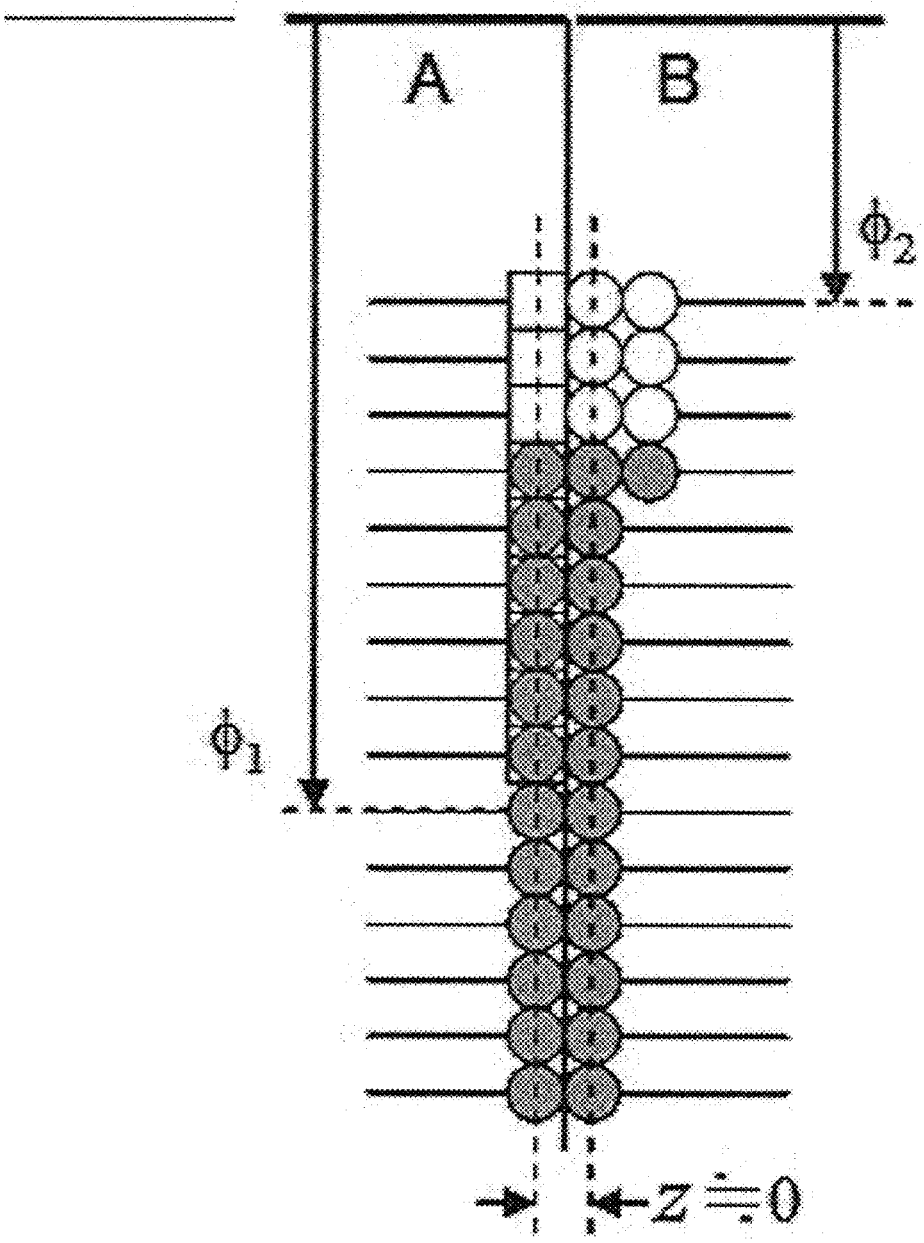
FIG. 2B depicts the energy level after substances A and B are in contact with each other, to illustrate the contact electrification theory regardless of a change in the electric potential and explain a preparation method of a color toner according to an exemplary embodiment of the present invention.

FIGS. 2A and 2B depicts the contact electrification based on Equation 6. In FIGS. 2A and 2B, electrons in black circles are counterbalanced so that the electrons have the same energy level in substances A and B.

If the change in the electric potential during the contact electrification is eliminated, the surface charge density may increase, in comparison to the situation in which it was necessary to take into account the change in the electric potential during the contact electrification. That is, comparing Equations 5 and 6, it can be observed that Equation 5 is obtained by adding a term, which includes the absolute value of distance z, dielectric constant ∈ and electron charge e, to the denominator of Equation 6. It can also be seen that the change in the electric potential may be controlled to reduce the surface charge density.

With respect to the relationship between toner charge-to-mass ratio Q/M and mixing ratio T/C, the contact electrification generally causes little change in the electric potential, and the change in the electric potential has almost no influence on electrification. A small change in the electric potential may cause the intensity of electric field ΔE formed between substances A and B to be reduced.

The electric field ΔE formed between substances A and B is represents a contact electric field formed in a contact portion between a toner and a carrier. The charge amount may be determined according to the intensity of the contact electric field.

Figure 3A:
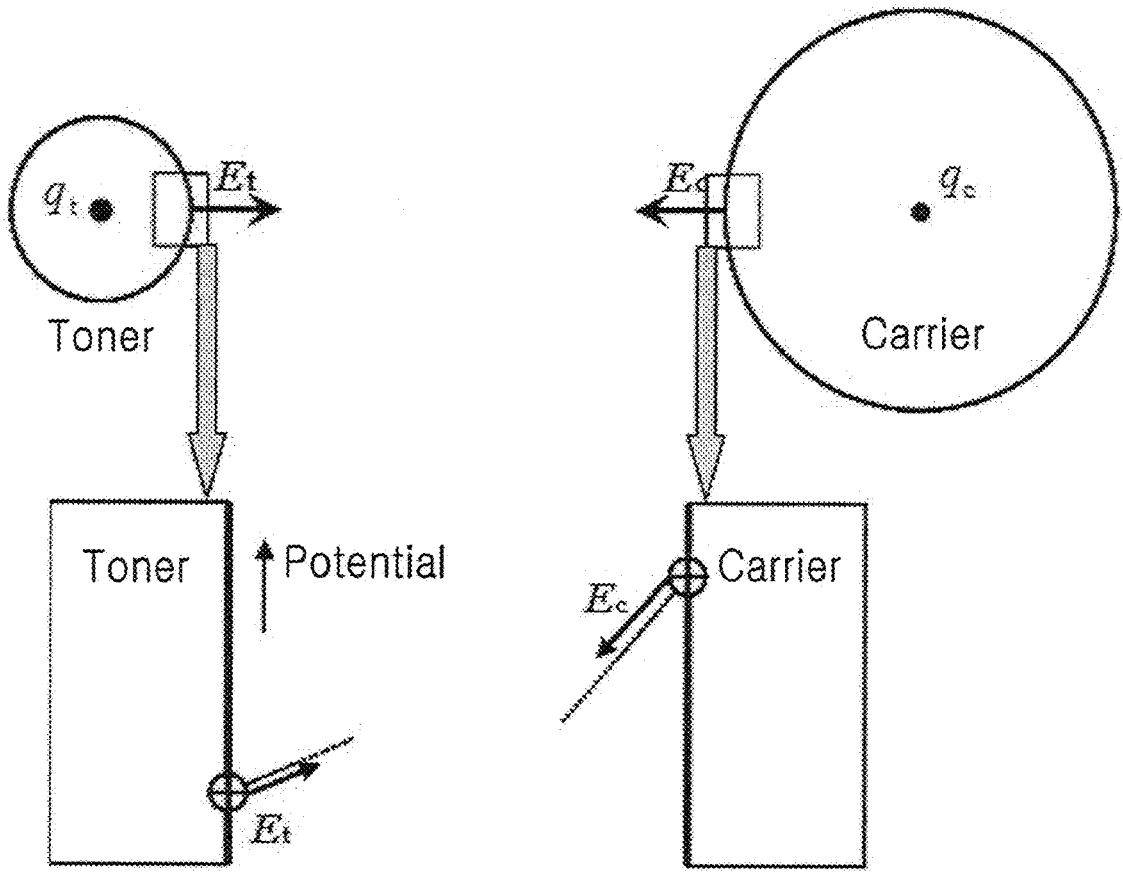
FIG. 3A depicts an outer electric field formed by contact between a conventional toner and a carrier.
Figure 3B:
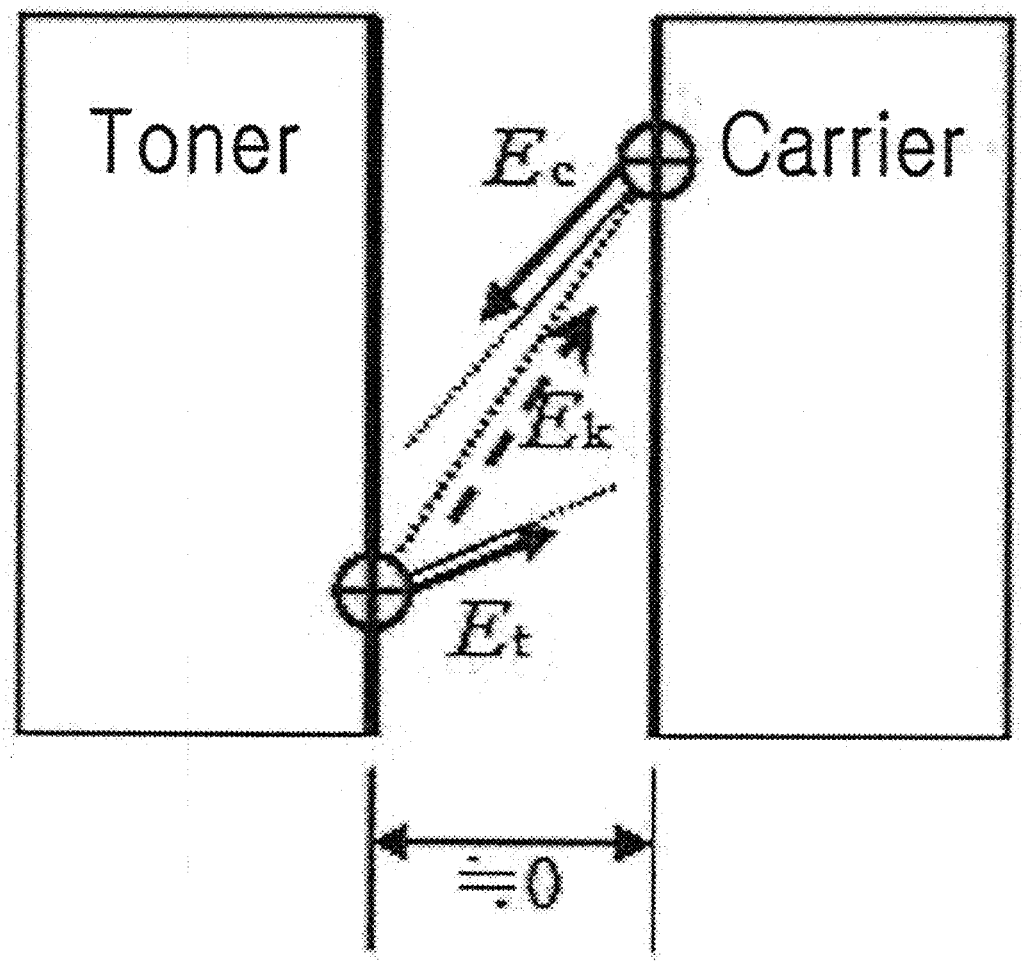
FIG. 3B depicts a contact electric field formed by contact between a conventional toner and a carrier.

FIG. 3A depicts an outer electric field formed by contact between a conventional toner and a carrier, and FIG. 3B depicts a contact electric field formed by contact between a conventional toner and a carrier. In FIGS. 3A and 3B, $E_t$ represents an outer electric field of the toner, $E_c$ represents an outer electric field of the carrier, and $E_k$ represents a contact electric field. Taking into consideration of the so-called Kondo effect known to those skilled in the art, the contact electric field may satisfy the following Equation 7.

$$E_k=(E_t-E_c)/2 \quad \text{\{Equation 7\}}$$

From Equation 7, the superposition principle is applicable to the electric field, the contact electric field may thus be theoretically represented by the following Equation 8.

$$E_k=E_t-E_c \quad \text{\{Equation 8\}}$$

There is a need for a means for controlling the charge amount of the toner with greater stability, taking into consideration electric field ΔE caused by the change in the electric potential according to the movement of electric charges based on surface state theory.

Electric charges are generally disposed slightly below the surface of the toner or the surface of the carrier. The electric field intensity between electric charges is described with reference to FIGS. 4A and 4B.

Figure 4A:
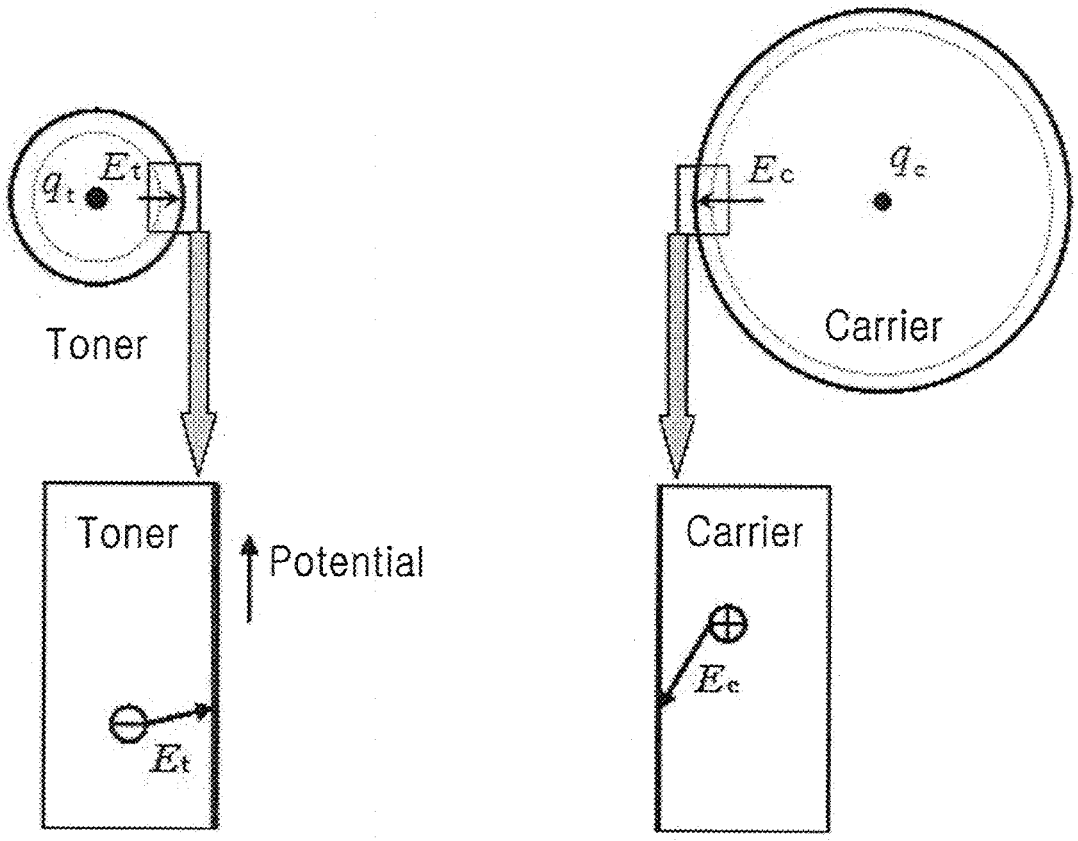
FIG. 4A depicts an inner electric field formed by contact between a new toner and a carrier.
Figure 4B:
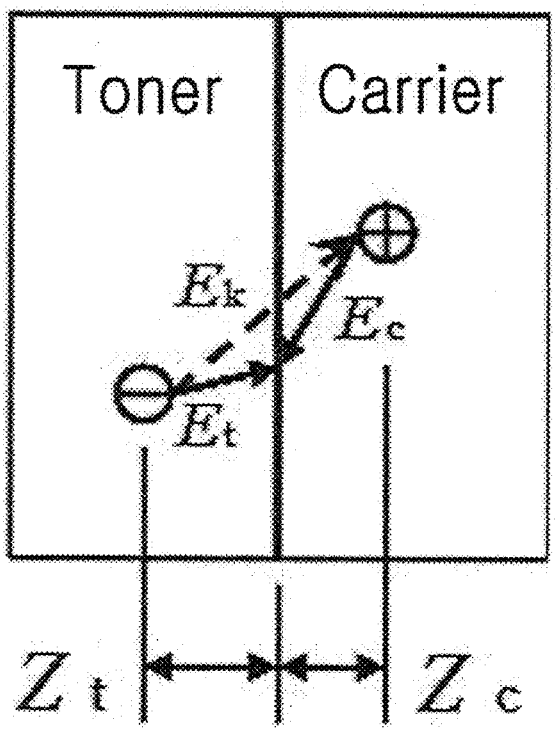
FIG. 4B depicts an inner contact electric field formed by contact between a new toner and a carrier.

As shown in FIG. 4A, an electric field is formed by electric charges disposed slightly below the surface of the toner or the surface of the carrier. In this situation, if the toner is in contact with the carrier, the relationship between the contact electric field $E_k$, the internal electric field $E_t$ of the toner and the internal electric field $E_c$ of the carrier is shown in FIG. 4B. For convenience of description, when $E_k$ is the average value of the contact electric field, the contact electric field may be represented by Equation 7.

The actual contact electric field however is not limited to the average value. In order to determine the intensity of the electric field, the position of electric charge, namely, the depth $Z_t$ between the electric charge to the surface of the toner or depth $Z_c$ between the electric charge to the surface of the carrier needs to be known, but it may not be impossible to know the precise position of the electric charge.

While it may not be possible to prepare a toner or a carrier by directly controlling the positions of electric charges, it is the realization by the present applicants that it is possible to regulate the internal electric field intensities, and to thereby control the charge amount.

To control the charge amount, the electric field intensity characteristics of materials within which the internal electric field is formed may be controlled. A solid materials, such as, for example, resins, each have an intrinsic dielectric strength. If an electric potential across a certain material exceeds the intrinsic dielectric strength, an electric discharge may occur, preventing a voltage in excess of the dielectric strength from being applied. For this reason, for example, electronic components, such as, condensers are required to have the dielectric strength suitable for the applied voltages.

If the dielectric strength near the surface of the toner or the surface of the carrier is controlled using the intrinsic dielectric strength, the electric field ΔE formed by the contact between the toner and carrier may be controlled based on the intrinsic dielectric strength.

Since the surface charge density is calculated by adding the dielectric constant and electric field according to Equation 4, the surface charge density may be regulated, and as a result it is possible to control the charge amount.

That is, if the accumulated electric charge is greater than a threshold level, the electric field intensity inside the toner may exceed the dielectric strength of the toner, and an electric discharge may thus occur. Therefore, a material, such as, for example, a resin, having an appropriate dielectric strength may desirably be used as the material for the toner to limit the accumulation of electric charge to a desirable level. There are various methods for controlling the dielectric strength.

A method for dispersing conductive materials, namely carbon black, is generally used to control the dielectric strength. Black toners containing carbon black, for various reasons, have desirable charge properties. Since carbon black cannot be used for color toners, however, transparent conductive materials may be dispersed to control the dielectric strength of the color toner. According to an embodiment, transparent antistatic agents may preferably be used as conductive materials.

According to an embodiment, in order to control the dielectric strength of the portion near the surface of the toner, carbon black in sufficiently small amount that has no influence on colors may be dispersed in the portion near the surface of the toner.

According to an embodiment, the dielectric strength of the resin with which the toner is formed may be additionally or in the alternative controlled. For example, if the proportional content of the low molecular weight component of the resin is increased, the dielectric strength may be reduced.

By the use of one or more of the above described methods, or a combination thereof, the dielectric strength can be controlled, thus making it possible to control the charge amount.

In order for the internal electric field formed according to the movement of electric charges to be greater than the dielectric strength, for example, according to an embodiment, the toner and carrier may be made of materials with low frictional charge polarity. That is, referring to the work function as described above, a large difference between work functions is made.

In the case of a negatively charged toner, an acryl resin having large positive-charging properties may preferably be used as the coating material for coating the surface of a carrier. Alternatively, a silicone resin having large positive polarity may be used.

Figure 5:
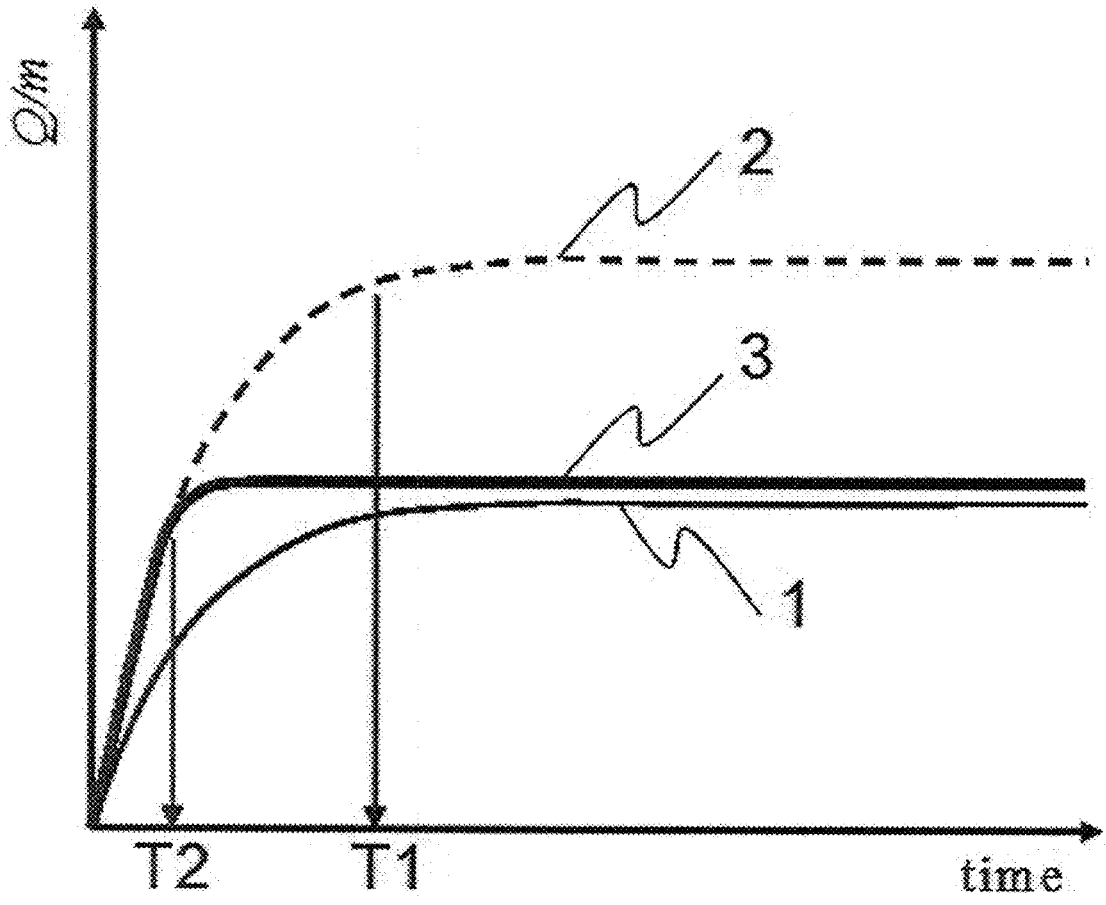
FIG. 5 is a graph to explain a reduction in a time required to charge a toner according to an exemplary embodiment of the present invention.

Referring now to FIG. 5, an aspect of the resent disclosure relating to high speed charging of the toner to a saturation value will be described. In FIG. 5, the curve 1 represents electrification of a conventional toner, which shows that the toner charge-to-mass ratio Q/M increases slowly, requiring time duration T1 to reach the saturation charge. If conventional toner is supplied and used for developing an image prior to T1, the toner may not be sufficiently charged, and toner scattering may thus occur.

If, in order to increase the rate of charging, a material having a polarity sufficiently high to cause a toner to be charged at a higher level is used as the coating material for a carrier, however, the absolute value of the charge amount may also increase, as shown in curve 2 of FIG. 5. While, in this case, the time required to reach a charge amount large enough to perform a proper developing operation T2 may be shorter than T1, and while if T2 is shorter than the time to transfer toner to the developing unit, toner scattering may be reduced, the absolute amount of the charge may nevertheless increase significantly. Because the print density is inversely proportional to the charge amount, the excessive charge may prevent an appropriate print density of the developed image, which makes a developer exhibiting characteristics of curve 2 less desirable or practical.

According to aspects of the present disclosure, the amount of charge may be controlled based on the electric discharge, which occurs when the intensity of the inverse electric field caused by frictional electrification exceeds the dielectric strength of the toner. In this regard, if a material having a similar initial charging characteristics shown in curve 2 of FIG. 5 but with a suitable dielectric strength is used, the intensity of the inverse electric field may exceed the dielectric strength of such toner, and an electric discharge may result. Accordingly, the toner charge-to-mass ratio Q/M to initially increase as shown in curve 2, but after the electric discharge, toner charge-to-mass ratio Q/M may be stabilized to be a value that may proximate the saturation charge value of curve 1. Accordingly, above described embodiments of developer may have the charging characteristics substantially as shown as curve 3 of FIG. 5.

According to another aspect of the present disclosure, the desired amount of charge of the toner may be controlled based on the relationship between the charge amount and the mixing ratio of toner and carrier. For example, as can be seen from the relationship between the toner charge-to-mass ratio Q/M and the toner-to-carrier mixing ratio T/C depicted in FIG. 6, in theory, as the T/C increases, Q/M is reduced slowly as represented by curves 4 and 5 of FIG. 6. A material having a polarity sufficiently high to cause the toner to be charged at a higher level may behave as indicated by the curve 5. On the other hand, a material having a low polarity may behave according to the curve 4. The amount of charge amount in curve 5 may generally be higher than that in curve 4.

According to above described embodiments, the amount of charge of the toner is limited to an upper limit. It would thus be desirable that the charge level remain relatively constant up to some mixing ratio as shown in curve 6 of FIG. 6. An inflection point on curve 6 indicates a mixing ratio, in which the toner is about 50% of the mixture.

If T/C is equal to or less than, for example, about 50%, frictional electrification may occur between the toner and the carrier, so that the amount of charge imparted to the toner may be controlled to a desired level. However, if T/C is greater than 50%, some toner particles may not be in direct contact with the carrier, and may receive electric charges from other toner particles, and, accordingly, the charge amount may be inversely proportional to T/C.

Figure 6:
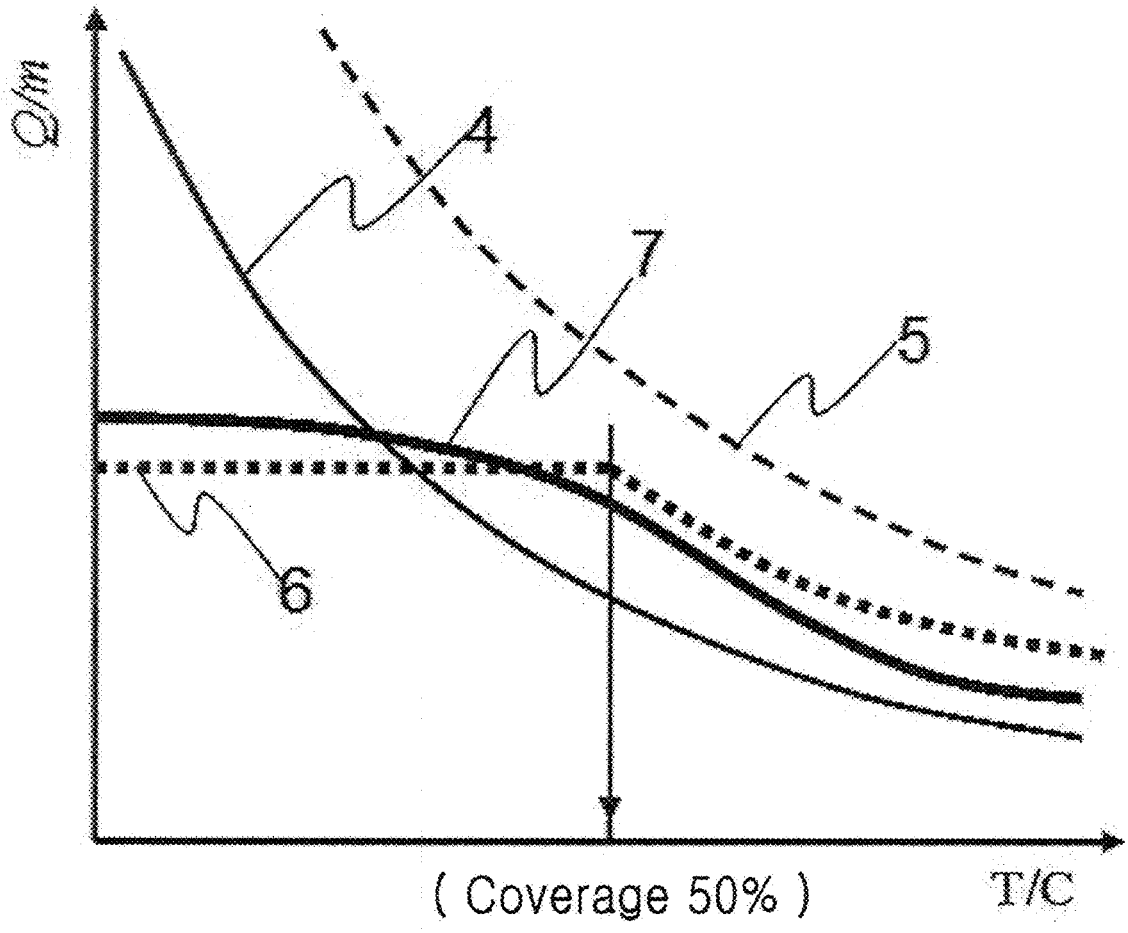
FIG. 6 is a graph to explain the relationship between toner charge-to-mass ratio Q/M and mixing ratio T/C of a toner to a carrier, according to an exemplary embodiment of the present invention.

In practice, the relationship between the charge amount and T/C may be shown as curve 7 of FIG. 6. Curve 7 does not show a clear inflection point as shown in curve 6, but if T/C remains a coverage of less than 50%, the reduction rate of the charge proportional to the toner increase, while somewhat higher than that of curve 6, may nevertheless be relatively small, and if T/C reaches a coverage of greater than 50%, the reduction rate of the amount of charge may be somewhat smaller than that of curve 6.

Curve 7 is affected by not only the toner but also the type of additive in the developer composition, such as the core material or the coating material of the carrier. This is because the inverse electric field formed in the contact portion between the toner and the carrier is affected by materials of the carrier as well. The Curve 7 of FIG. 6 may be modulated up or down slightly according to the type of carrier. However, when the toner is separated from the binary developer, the electric charges of the carrier may be almost discharged to be approximately 0, so that only the charge amount of the toner may need to be considered.

It may be important to select materials for the toner and the carrier capable of generating a sufficient charge amount before incorporating substance(s) for reducing the dielectric strength into the toner. In other words, suitable charge control agent or coating material of the carrier of the developer may need to be selected so as to allow the charging to an amount greater than the desired charge amount of the toner in actual use. The charge amount may be further adjusted to the desired level by incorporating the substance(s) for reducing the dielectric strength into the toner.

It can be observed from FIG. 6, the relationship between the charge amount and the toner concentration of toner prepared according to the embodiments above described as shown in curve 7 is, up to the coverage of 50% of the toner is substantially similar to curve 6. It can also be observed that the conventional toner, for example, an insulating toner, exhibits a reduction rate of the charge amount in relation to the increase in the toner concentration may be drastically higher, so e.g., the charge amount may be 0 at 65% of the toner concentration.

The color toner according to an embodiment of the present disclosure has a dielectric strength equal to or lower than that of a black toner that contains carbon black. According to an embodiment, the dielectric strength of the color toner may desirably be in a range of approximately 10000 V/cm to approximately 120000 V/cm.

If the dielectric strength of the color toner is less than 10000 V/cm, the developer may exhibit conductivity when an electric field formed in the developing unit. For example, if a potential difference between a photosensitive medium and the developing roller is approximately 500 V, and if the photosensitive medium is spaced apart from the developing roller by approximately 0.05 centimeter (cm), the intensity of the electric field formed between the photosensitive medium and the developing roller may be approximately 10000 V/cm. In this situation, if electricity is allowed to flow at approximately 10000 V/cm, the charge amount of the toner may change. Accordingly, while a toner having a low dielectric strength can practically be used as a conductive toner, but in this situation, because the electric charges may flow back from the transferring charging device and/or may be discharged, various additional consideration may need to be given, for example, a provision an insulating sheet, or the like. It is therefore preferable that the dielectric strength of the color toner be greater than approximately 10000 V/cm.

The toner according to the embodiments herein described may be used in an electrophotographic apparatus, may provide improved charging speed and/or greater stability over environmental conditions, and thus may reduce fog phenomenon, toner scattering, contamination of the developing device and/or significant print density variations.

According to other aspects, the contact electric field between the toner and the carrier can be controlled to have substantially constant intensity level, and thereby maintain the charge amount of the toner to a desirable amount, enabling faster charging of the toner and improved charge stability even when the environment changes.

While the above embodiments are described primarily with respect to color toner, the embodiments are also applicable to black toner that does not use carbon black as the colorant. If a toner employing a black colorant other than carbon black is used, initiation of electrification may be delayed and the charge stability against changes in the environment may be reduced, in a similar manner to a situation in which the conventional color toner is used. Accordingly, if a technique for using the color toner according to the exemplary embodiment of the present invention is applied to a black toner in which a black colorant other than carbon black is used, the desired charge amount may be reach more rapidly with an improved print density stability over changes in the environment. Black colorants other than carbon black may include, for example, titanium oxide-based black fine powders, an example of which may be Tilack D manufactured by Ako Kasei Co., Ltd of Ako-shi, Japan.

Several specific examples of color toner consistent with one or more of the above described embodiments are provided below. However, it should be understood that the present invention is by no means restricted by such specific examples. In the following examples, 'parts' means 'parts by weight.'

EXAMPLE 1

Preparation of Pulverized Toner Containing Antistatic Agent

The following composition was used to prepare a pulverized toner using Pelestat 300, manufactured by Sanyo Chemical Industries, Ltd. of Kyoto, Japan, as an antistatic agent.

| Composition | Content (parts) |
|---|---|
| Styrene-acryl copolymer resin (coarsely crushed into particles with an average diameter of approximately 1 mm) | 100 |
| C.I. pigment blue-15 (colorant) | 5 |
| Pelestat 300 (antistatic agent) | 7 |
| Polypropylene wax (number average molecular weight = 7000) | 3 |

The above components were pre-mixed in a V-shaped mixer, and the resultant mixture was kneaded using a continuous extruder and then cooled. After cooling, the mixture was roughly pulverized, then finely pulverized by a jet mill, and subsequently classified using wind power to obtain a cyan toner with an average particle diameter of approximately 8 μm.

100 parts of the prepared cyan toner were mixed with 0.4 part of silica powder (AEROSIL R972, manufactured by Nippon Aerosil Co., Ltd. Of Osaka, Japan) and 0.1 part of titanium oxide powder (AEROSIL T805, manufactured by Nippon Aerosil Co., Ltd.) in a Henschel Mixer, to obtain an external additive toner.

EXAMPLE 2

Preparation of Polymerized Toner on which a Carbon Black-Added Layer is Formed Ketjenblack EC600JD (manufactured by LION Corp. of Tokyo, Japan) was used as the carbon black, and C.I. pigment blue-15 was used as the colorant.

Preparation of Carbon Black-Added Layer Forming Agent 1000 ml of purified water, 20 g of dodecyl sodium sulfate, 20 g of Ketjenblack EC600JD and 160 g of polypropylene, with the number average molecular weight of 3400, were mixed together. The mixture was then dispersed with a homogenizer while being slowly heated, to form an emulsified solution.

To the emulsified solution were added 300 g of low molecular weight polypropylene, 1000 g of styrene monomer, 200 g of n-butyl acrylate monomer, 50 g of methacrylic acid monomer, and 1000 ml of purified water adjusted to the same temperature as the emulsified solution, and the mixture was then dispersed with the homogenizer, to form the carbon black-added layer forming agent.

The carbon black-added layer forming agent may continue to be used in the emulsion polymerization reaction to obtain a black toner.

Preparation of Color Toner Main Particles 1000 ml of purified water, 20 g of dodecyl sodium sulfate, 80 g of C.I. pigment yellow-17, and 160 g of polypropylene, with the number average molecular weight of 3400, were mixed together. The mixture was then dispersed with a homogenizer while being slowly heated, to form an emulsified solution.

To the emulsified solution were added 300 g of low molecular weight polypropylene, 1000 g of styrene monomer, 200 g of n-butyl acrylate monomer, 50 g of methacrylic acid monomer, and 1000 ml of purified water adjusted to the same temperature as the emulsified solution, and the mixture was then maintained at 75° C. for 3 hours to allow the emulsion polymerization reaction.

Formation of Carbon Black-Added Layer 200 g of the carbon black-added layer forming agent was added to the emulsion-polymerized solution, and the emulsion polymerization reaction was continuously performed on the mixture at 75° C. for 1 hour.

Preparation of Toner

The reaction solution obtained after performing the emulsion polymerization reaction was filtered, washed with water, dried and pulverized to obtain toner particles.

100 parts of the toner were mixed with 0.4 part of silica powder (AEROSIL R972, manufactured by Nippon Aerosil Co., Ltd.) and 0.1 part of titanium oxide powder (AEROSIL T805, manufactured by Nippon Aerosil Co., Ltd.) in a Henschel Mixer, to obtain an external additive toner.

COMPARATIVE EXAMPLE 1

A color toner was prepared in the same manner as in Example 1, except that the antistatic agent was not added.

COMPARATIVE EXAMPLE 2

A color toner was prepared in the same manner as in Example 2, except that the carbon black-added layer was not formed.

COMPARATIVE EXAMPLE 3

A black toner was prepared using a general pulverizing method, in the same manner as Example 1, except that 5 parts of carbon black was used as a colorant instead of C.I. pigment blue-15.

Evaluation

The toners prepared in Examples 1 and 2 and Comparative Examples 1 to 3 were evaluated for their volume resistivity and dielectric strength, and results of the evaluation in using the toners in an image forming apparatus were compared.

Test of Volume Resistivity

A pressure of approximately 100 kg/cm$^2$ was applied to each of the toners prepared in Examples 1 and 2 and Comparative Examples 1 to 3 using a pressurizer. Then, each of the toners was pressed and molded into a cylindrical-shaped pellet with a thickness of approximately 1-2 mm and a diameter of approximately 50 mm in accordance with the Japanese Industrial Standard, JIS K 6911.

A copper tape with a conductive adhesive was attached to each side of the pellet as an electrode, so that the copper tape was spaced apart by approximately 10 mm from an edge of one side of the pellet. The magnitude of the electrode was adjusted according to the length of the pellet. A guard ring was attached to an edge of the pellet, so as to eliminate the effect of surface conduction. The voltage was measured from 100 V, and increasing by a factor of 10 until reaching the breakdown voltage. This measurement was performed at 23±1° C. and 50±10% RH.

When an electric field intensity of 10000 V/cm was applied, the volume resistivity of the pellet of the external additive toner in Example 1 was $10^{14}$ Ωcm; and, when an electric field intensity of 100000 V/cm was applied, the volume resistivity of the pellet was $10^{10}$ Ωcm.

When an electric field intensity of 10000 V/cm was applied, the volume resistivity of the pellet of the external additive toner in Example 2 was $10^{14}$ Ωcm; and when an electric field intensity of 100000 V/cm was applied, the volume resistivity of the pellet was $10^{13}$ Ωcm. Because rhe conductive carbon black was added only to the surface layer of the toner, when a high electric field intensity was applied, the volume resistivity also increased.

When an electric field intensity of 10000 V/cm was applied, the volume resistivity of the pellet of the external additive toner in Comparative Example 1 was $10^{16}$ Ωcm; and when an electric field intensity of 100000 V/cm was applied, the volume resistivity of the pellet was $10^{15}$ Ωcm.

When an electric field intensity of 10000 V/cm was applied, the volume resistivity of the pellet of the external additive toner in Comparative Example 2 was $10^{16}$ Ωcm; and when an electric field intensity of 100000 V/cm was applied, the volume resistivity of the pellet was $10^{15}$ Ωcm.

When an electric field intensity of 10000 V/cm was applied, the volume resistivity of the pellet of the external additive toner in Comparative Example 3 was $10^{14}$ Ωcm. When an electric field intensity of 100000 V/cm was applied, the initial volume resistivity of the pellet was $10^{12}$ Ωcm, but as the voltage is continued to be applied, dielectric breakdown began.

Based on the above results, the toners prepared in Examples 1 and 2 and Comparative Example 3 had a lower volume resistivity than the toners prepared in Comparative Examples 1 and 2.

Test of Dielectric Strength

The dielectric breakdown voltage Vbk is a voltage at which current leakage rapidly increases as a result of connecting a high voltage power supply to the measuring electrodes and gradually increasing the applied voltage. The dielectric strength is determined by dividing the dielectric breakdown voltage Vbk by the thickness of the pellet.

The measurement ambient conditions were the same as those of the volume resistivity.

The pellet of the external additive toner in Example 1 had a dielectric strength of approximately 110000 V/cm.

The pellet of the external additive toner in Example 2 had a dielectric strength of approximately 120000 V/cm. The carbon black-added layer on the surface layer of the toner may be used as an electrically conductive path, so it is understood that a portion having a high volume resistivity has a low dielectric strength.

The pellet of the external additive toner in Comparative Example 1 had a dielectric strength of approximately 160000 V/cm.

The pellet of the external additive toner in Comparative Example 2 had a dielectric strength of approximately 160000 V/cm.

The pellet of the external additive toner in Comparative Example 3 had a dielectric strength of approximately 100000 V/cm.

As a result of comparison, it was found that the pellets manufactured using the external additive toners in Comparative Examples 1 and 2 had considerably higher dielectric strength.

Tests of Print Test Evaluation Apparatus

Preparation of Binary Developer

The external additive toners in Examples 1, 2 and Comparative Examples 1 to 3 were coated with a silicone resin manufactured by Kanto Denka Kogyo Co., Ltd. of Tokyo, Japan, and the coated toners were combined with MnMg based ferrite carriers with an average particle diameter of approximately 45 μm, to obtain binary developers. Here, the content of the toner was adjusted to be approximately 8% by weight based on the total parts by weight of the binary developer.

Various silicone resins may be used to coat the toners, but in these examples, the type and amount of silicone resin were selected in order that the charge amount of the toners was set to be approximately 20 μC/g.

Binary developers were prepared using the toners in Examples 1, 2 and Comparative Examples 1 to 3. The prepared binary developers were inserted into a print test evaluation printing apparatus (on paper A4, 40 ppm, the amount of developer of 250 g), to evaluate the results of printing.

(1) Results of Environmental Evaluation

The charge amount of each of the binary developers was evaluated under a normal temperature-normal humidity (NN) environment (23° C., 50% RH), a low temperature-low humidity (LL) environment (15° C., 15% RH) and under a high temperature-high humidity (HH) environment (30° C., 85% RH). The results are shown in Table 1 below.

The binary developers containing the toners in Examples 1, 2 and Comparative Example 3 had excellent charge stability against changes in the environment as shown in Table 1.

(2) Contamination in Developing Device when Printing is Continuously Performed at the Print Density of 30%

When the binary developer containing the toner of Example 1 was used, no contamination occurred in the developing device, and scattered toner particles did not accumulate outside the developing device.

When the binary developer containing the toner of Example 2 was used, no contamination occurred in the developing device, and scattered toner particles did not accumulate outside the developing device.

When the binary developer containing the toner of Comparative Example 1 was used, contamination occurred in the developing device, and a large amount of scattered toner particles accumulated on a black outside cover of the developing device such that the black outside cover was covered with blue toner particles.

When the binary developer containing the toner of Comparative Example 2 was used, contamination occurred in the developing device, and a large amount of scattered toner particles, though to a less extent than for Comparative Example 1, accumulated on the black outside cover of the developing device.

(3) Color Test

The binary developer containing the toner prepared in Example 2 was prepared by forming the carbon black-added layer on the surface of the toner, but there was almost no influence on developed colors (as a result of visual observation).

That is, since carbon black was added only to the surface of the toner such that it was not observed visually while enabling the charge amount to be stabilized. This method was thus effective, and did not result in noticeable change of the color.

TABLE 1

| Item | Binary developer containing toner in Example 1 | Binary developer containing toner in Example 2 | Binary developer containing toner in Comparative Example 1 | Binary developer containing toner in Comparative Example 2 | Binary developer containing toner in Comparative Example 3 |
|---|---|---|---|---|---|
| Dielectric Strength (V/cm) | 110000 | 120000 | 160000 | 160000 | 100000 |
| Charge amount (μC/g) under NN | 20 | 20 | 20 | 20 | 20 |
| Charge amount (μC/g) under LL | 23 | 22 | 25 | 27 | 22 |
| Charge amount (μC/g) under HH | 17 | 16 | 10 | 13 | 17 |
| Contamination in Developing device | No | No | Serious | Slight | No |

Based on the results shown in Table 1, it can be seen that the respective dielectric strength of the color toner of Examples 1 and 2 is approximately equal to that of the black toner containing carbon black (Comparative Example 3), but the charge stability of the toners have significantly improved.

The toners prepared in Examples 1 and 2 having substantially the same dielectric strength as the black toner containing carbon black have excellent charge stability against changes in the environment, and can be charged at higher charging rate particularly suitable for high speed printing.

While the disclosure has been particularly shown and described with reference to several embodiments thereof with particular details, it will be apparent to one of ordinary skill in the art that various changes may be made to these embodiments without departing from the principles and spirit of the invention, the scope of which is defined in the following claims and their equivalents.

What is claimed:

1. A toner for use in developing an electrostatic latent image in an image forming apparatus, comprising:

a colorant that does not contain carbon black;

a dielectric strength control agent, the dielectric strength control agent causing a dielectric strength of the toner to be lower than it would have been without the dielectric strength control agent, and the dielectric strength control agent comprising a layer formed on an outer surface of the toner, and the layer containing carbon black; and a binder resin to bind the colorant and the dielectric strength control agent together.

2. The toner of claim 1, wherein the toner is not a black toner, and the dielectric strength of the toner is substantially equal to or lower than that of a black toner containing carbon black.

3. The toner of claim 2, wherein the dielectric strength of the toner is within a range of approximately 10000 V/cm to approximately 120000 V/cm.

4. The toner of claim 3, wherein the dielectric strength control agent comprises a substantially transparent electrically conductive material.

5. The toner of claim 4, wherein the dielectric strength control agent comprises a resin having a volume resistivity equal to or lower than $10^9$ Ω·cm.

6. The toner of claim 3, wherein the toner is black toner.

* * * * *